US008178803B2

(12) United States Patent
Chang et al.

(10) Patent No.: US 8,178,803 B2
(45) Date of Patent: May 15, 2012

(54) ELECTRONIC DEVICE HAVING KEY

(75) Inventors: Chia-Yuan Chang, Taipei Hsien (TW); Cheng-Pang Wang, Taipei Hsien (TW); I-Huei Huang, Taipei Hsien (TW); Wen-Neng Liao, Taipei Hsien (TW)

(73) Assignee: Acer Incorporated, New Taipei (TW)

( * ) Notice: Subject to any disclaimer, the term of this patent is extended or adjusted under 35 U.S.C. 154(b) by 253 days.

(21) Appl. No.: 12/768,751

(22) Filed: Apr. 28, 2010

(65) Prior Publication Data

US 2011/0198205 A1 Aug. 18, 2011

(30) Foreign Application Priority Data

Feb. 12, 2010 (TW) ..... 99104828 A

(51) Int. Cl.
*H01H 9/04* (2006.01)

(52) U.S. Cl. ..... 200/302.1; 200/306

(58) Field of Classification Search ..... 200/302.1, 200/306, 512
See application file for complete search history.

(56) References Cited

U.S. PATENT DOCUMENTS

| | | | | |
|---|---|---|---|---|
| 4,468,542 | A * | 8/1984 | Pounds | 200/306 |
| 7,973,255 | B2 * | 7/2011 | Purcocks | 200/345 |
| 2002/0163451 | A1 * | 11/2002 | Johnston et al. | 341/22 |
| 2004/0022573 | A1 * | 2/2004 | Yamauchi | 400/489 |
| 2006/0227503 | A1 | 10/2006 | Ho et al. | |
| 2010/0187082 | A1 * | 7/2010 | Purcocks | 200/5 A |
| 2010/0232861 | A1 * | 9/2010 | Shibata et al. | 400/491 |

FOREIGN PATENT DOCUMENTS

TW M265694 5/2005

* cited by examiner

*Primary Examiner* — Briggitte R Hammond
(74) *Attorney, Agent, or Firm* — Jianq Chyun IP Office

(57) ABSTRACT

An electronic device including a main body, a carrying layer disposed at the main body, a waterproof layer stacked on the carrying layer and located between the carrying layer and the main body, a supporting element disposed on the carrying layer, a key disposed on the supporting element, and a guiding element connected to the key is provided. The main body has an inner space and an opening exposing the inner space. The carrying layer covering the opening has a first ventilation hole and an assembly hole. The waterproof layer has a second ventilation hole. The first ventilation hole is exposed by the second ventilation hole and connected with the inner space. The assembly hole is covered by the waterproof layer. The supporting element covers the first ventilation hole and has a third ventilation hole connected with the first ventilation hole. The guiding element is locked at the assembly hole.

10 Claims, 2 Drawing Sheets

ELECTRONIC DEVICE HAVING KEY

CROSS-REFERENCE TO RELATED APPLICATION

This application claims the priority benefit of Taiwan application serial no. 99104828, filed on Feb. 12, 2010. The entirety of the above-mentioned patent application is hereby incorporated by reference herein and made a part of specification.

BACKGROUND OF THE INVENTION

1. Field of the Invention

The present invention generally relates to an electronic device, and more particularly, to an electronic device having a key.

2. Description of Related Art

A notebook computer offers the same functions as a desktop computer but smaller size and lighter weight. Accordingly, notebook computer has become one of the most indispensable portable tools to some users. Some users even completely replace desktop computers with notebook computers along with the price reduction of the notebook computers.

FIG. 1 is a partial view of a conventional notebook computer. Referring to FIG. 1, generally speaking, the keyboard of the notebook computer includes a carrying layer 50 and keys 60 disposed on the carrying layer 50. As shown in FIG. 1, a waterproof layer 70 is further disposed under the carrying layer 50 in order to prevent liquid from entering the notebook computer through the assembly hole 52 on the carrying layer 50 and accordingly damaging the motherboard. However, the heat produced by the notebook computer when the notebook computer is in operation cannot be dissipated due to the disposition of the waterproof layer 70. As a result, the motherboard may be overheated and accordingly the system may not be able to work properly or even fail.

In Taiwan patent No. M265694, an opening is formed on the waterproof layer of the keyboard and a waterproof and breathable layer is disposed at the opening, such that liquid can be blocked while the heat produced can still be dissipated through fine meshes on the waterproof and breathable layer. Similar to this technique disclosed in Taiwan patent No. M265694, a technique of forming a plurality of pinholes on the waterproof layer of a keyboard so as to achieve a waterproof and heat dissipation effect is disclosed in U.S. patent No. 20060227503. However, only a limited amount of heat can be dissipated through the opening, and the waterproof performance will be affected if the opening is enlarged to improve the heat dissipation performance. Thereby, a good heat dissipation performance and a good waterproof performance cannot be achieved at the same time.

SUMMARY OF THE INVENTION

Accordingly, the present invention is directed to an electronic device having a key, wherein the electronic device offers both a good waterproof performance and a good heat dissipation performance.

The present invention provides an electronic device having a key. The electronic device includes a main body, a carrying layer, a waterproof layer, a supporting element, the key, and a guiding element. The main body has an inner space and an opening, wherein the opening exposes the inner space. The carrying layer is disposed at the main body and covers the opening. The carrying layer has a first ventilation hole and an assembly hole. The waterproof layer is stacked on the carrying layer and located between the carrying layer and the main body. The waterproof layer has a second ventilation hole. The first ventilation hole is exposed by the second ventilation hole and connected with the inner space, and the assembly hole is covered by the waterproof layer. The supporting element is disposed on the carrying layer and covers the first ventilation hole. The supporting element has at least one third ventilation hole, wherein the third ventilation hole is connected with the first ventilation hole. The key is disposed on the supporting element. The guiding element is locked at the assembly hole and connected to the key.

The present invention provides an electronic device having a key. The electronic device includes a main body, a carrying layer, a waterproof layer, a supporting element, and the key. The main body has an inner space and an opening, wherein the opening exposes the inner space. The carrying layer is disposed at the main body and covers the opening. The carrying layer has a first ventilation hole. The waterproof layer is stacked on the carrying layer and located between the carrying layer and the main body. The waterproof layer has a second ventilation hole. The first ventilation hole is exposed by the second ventilation hole and connected with the inner space. The supporting element is disposed on the carrying layer and covers the first ventilation hole. The supporting element has at least one third ventilation hole, wherein the third ventilation hole is connected with the first ventilation hole. The key is disposed on the supporting element.

According to an embodiment of the present invention, the carrying layer and the waterproof layer are formed integrally.

According to an embodiment of the present invention, the supporting element is elastic, and the key is suitable for moving along a direction substantially perpendicular to the carrying layer through elastic deformation of the supporting element.

According to an embodiment of the present invention, the third ventilation hole is a first distance away from the carrying layer, the apex of the supporting element is a second distance away from the carrying layer, and the first distance is greater than a quarter of the second distance.

The present invention provides an electronic device having a key. The electronic device includes a main body, a partition board, a supporting element, and the key. The main body has an inner space and an opening, wherein the opening exposes the inner space. The partition board is disposed at the main body and covers the opening. A ventilation channel is formed on the partition board for exposing the inner space. The supporting element is disposed on the partition board and covers the ventilation channel. The supporting element has at least one ventilation hole, and the ventilation hole is connected with the ventilation channel. The key is disposed on the supporting element.

According to an embodiment of the present invention, the partition board includes a carrying layer and a waterproof layer, the supporting element is directly disposed on the carrying layer, and the waterproof layer is stacked on the carrying layer and located between the carrying layer and the main body.

According to an embodiment of the present invention, the carrying layer and the waterproof layer respectively have a first ventilation hole and a second ventilation hole, and the first ventilation hole and the second ventilation hole are connected with each other to form the ventilation channel.

As described above, in the present invention, the waterproof layer covers the assembly hole on the carrying layer so that liquid is prevented from entering the electronic device through the assembly hole and accordingly a waterproof effect is achieved. In addition, the ventilation hole of the supporting element, the ventilation hole of the carrying layer, the ventilation hole of the waterproof layer, and the inner space of the main body of the electronic device are connected with each other so that hot air inside the electronic device can be expelled and accordingly a heat dissipation effect is achieved.

BRIEF DESCRIPTION OF THE DRAWINGS

The accompanying drawings are included to provide a further understanding of the invention, and are incorporated in and constitute a part of this specification. The drawings illustrate embodiments of the invention and, together with the description, serve to explain the principles of the invention.

DESCRIPTION OF THE EMBODIMENTS

Figure 1:
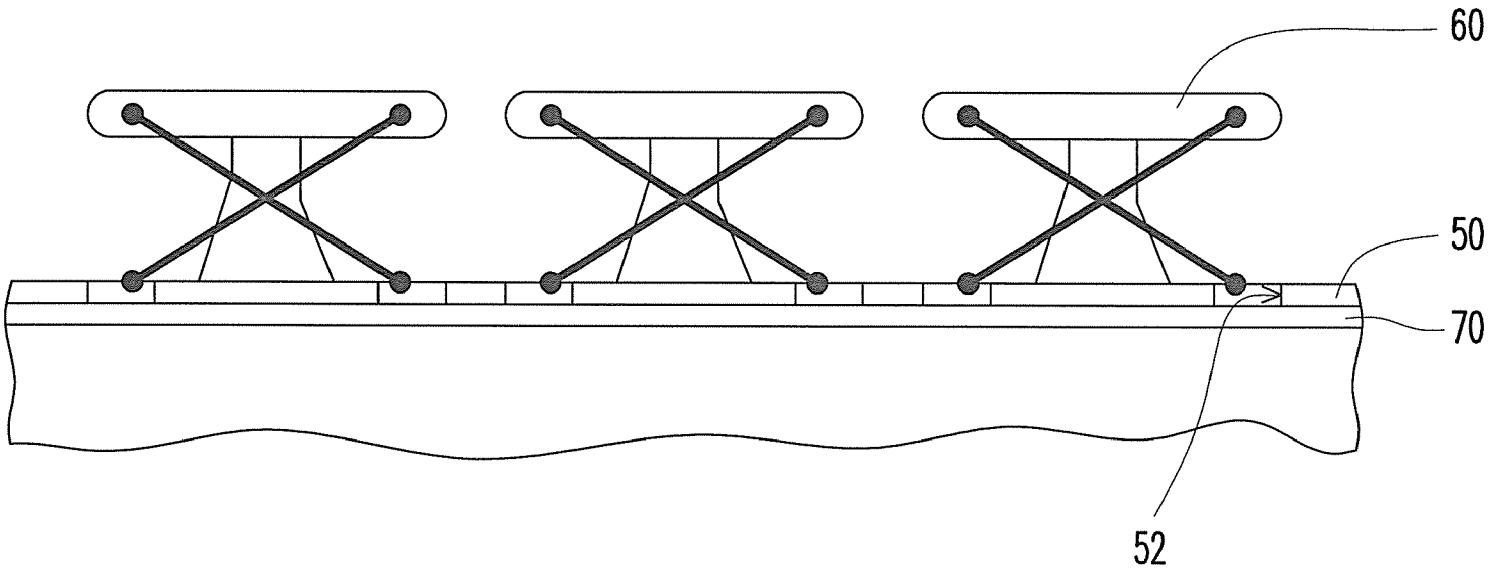
FIG. 1 (RELATED ART)
FIG. 1 is a partial view of a conventional notebook computer.

Reference will now be made in detail to the present preferred embodiments of the invention, examples of which are illustrated in the accompanying drawings. Wherever possible, the same reference numbers are used in the drawings and the description to refer to the same or like parts.

Figure 2:
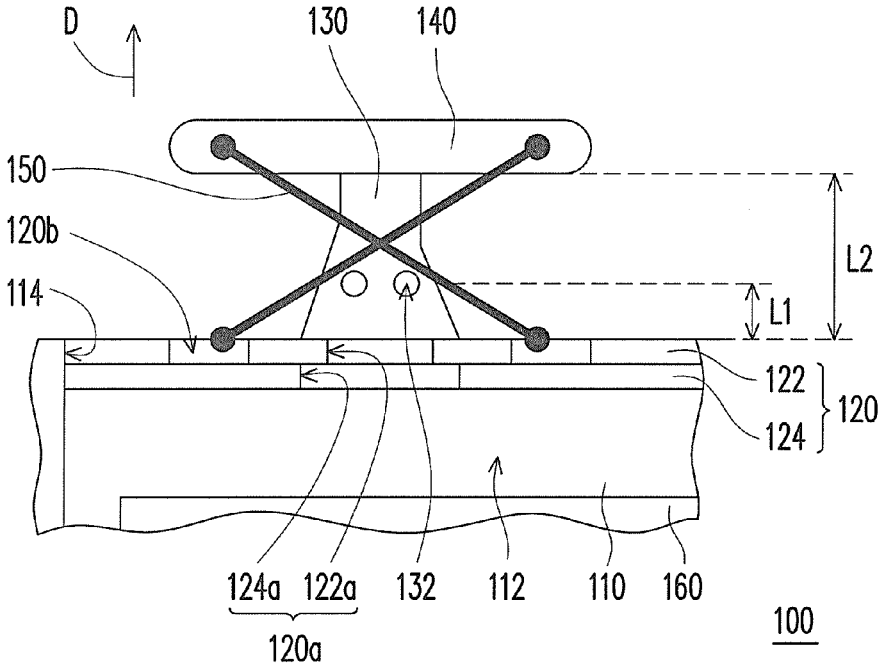
FIG. 2 is a partial view of an electronic device having a key according to an embodiment of the present invention.
Figure 3:
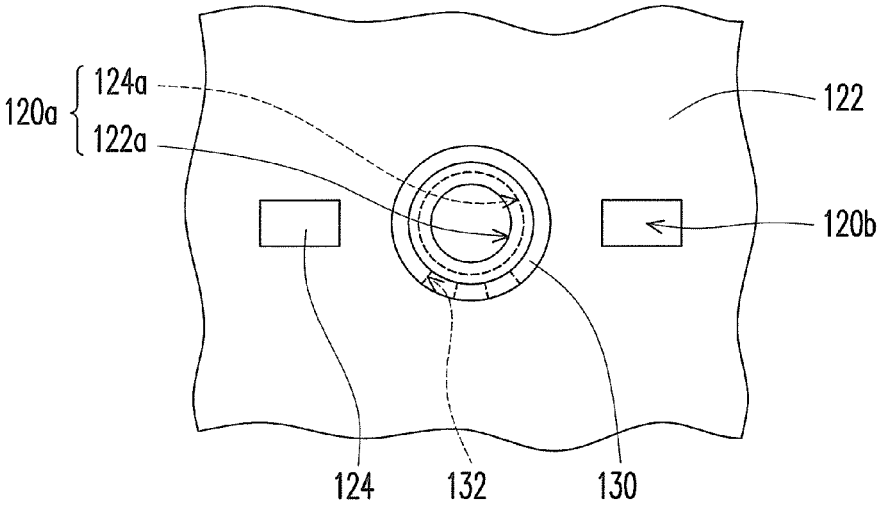
FIG. 3 is a top view illustrating some components of the electronic device in FIG. 2.

FIG. 2 is a partial view of an electronic device having a key according to an embodiment of the present invention. FIG. 3 is a top view illustrating some components of the electronic device in FIG. 2. To make the illustration clear to see, a key 140 and a guiding element 150 in FIG. 2 are not illustrated in FIG. 3. Referring to FIG. 2 and FIG. 3, in the present embodiment, the electronic device 100 includes a main body 110, a partition board 120, a supporting element 130, and the key 140. The electronic device 100 may be a notebook computer. However, the present invention is not limited thereto, and the electronic device 100 may also be any other electronic device having a key in another embodiment of the present invention.

The main body 110 has an inner space 112 and an opening 114. A motherboard 160 and other heat generating elements (not shown) of the notebook computer are disposed in the inner space 112, wherein the opening 114 exposes the inner space 112. The partition board 120 is disposed at the main body 110 and covers the opening 114, wherein a ventilation channel 120*a* is formed on the partition board 120 for exposing the inner space 112. The supporting element 130 is disposed on the partition board 120 and covers the ventilation channel 120*a*. The key 140 is disposed on the supporting element 130 to be pressed by a user. The supporting element 130 has at least one ventilation hole 132 (two are illustrated). The ventilation holes 132 are connected with the ventilation channel 120*a* so that heat produced by the motherboard 160 and other heat generating elements in the inner space 112 can be expelled to the outside. To be specific, in the present embodiment, the supporting element 130 may be a hollow funnel-shaped structure, and the ventilation holes 132 are disposed on the exterior wall of the supporting element 130 to be connected with the ventilation channel 120*a*.

To be specific, in the present embodiment, the partition board 120 is composed of a carrying layer 122 and a waterproof layer 124. The waterproof layer 124 is stacked on the carrying layer 122 and located between the carrying layer 122 and the main body 110. The supporting element 130 is directly disposed on the carrying layer 122. The carrying layer 122 and the waterproof layer 124 respectively have a ventilation hole 122*a* and a ventilation hole 124*a*, and the ventilation hole 122*a* and the ventilation hole 124*a* are connected with each other to form the ventilation channel 120*a*.

In the present embodiment, the waterproof layer 124 may be an aluminium foil layer attached to the lower surface of the carrying layer 122. However, the present invention is not limited thereto, and in other embodiments, the carrying layer 122 and the waterproof layer 124 may also be integrally formed.

Referring to FIG. 2 and FIG. 3, in the present embodiment, the carrying layer 122 further has an assembly hole 120*b*, and the electronic device 100 further includes a guiding element 150. The guiding element 150 is locked to the assembly hole 120*b* and connected to the key 140. The supporting element 130 may be an elastic component such that the key 140 can move along a direction D substantially perpendicular to the carrying layer 122 through the elastic deformation of the supporting element 130 and can be conveniently pressed by a user. The guiding element 150 restricts the movement of the key 140 to be along the direction D so that the key 140 will not be tilted when the user applies an improper pressing force.

It should be noted that in the present embodiment, the waterproof layer 124 covers the assembly hole 120*b* of the carrying layer 122 to prevent liquid from entering the electronic device 100 through the assembly hole 120*b*. In other words, in the present embodiment, the ventilation hole 124*a* of the waterproof layer 124 is connected with the ventilation hole 122*a* of the carrying layer 122 and does not overlap the assembly hole 120*b* of the carrying layer 122. Thus, the waterproof performance is prevented from being affected by the connection between the assembly hole 120*b* and the inner space 112 of the main body 110 at the same time when the heat is dissipated through the ventilation holes 132 of the supporting element 130, the ventilation hole 122*a* of the carrying layer 122, and the ventilation hole 124*a* of the waterproof layer 124.

To be more specific, in the present embodiment, the ventilation holes 132 of the supporting element 130 are kept a specific distance away from the carrying layer 122 so that liquid spilled on the carrying layer 122 is prevented from entering the supporting element 130 through the ventilation holes 132. Referring to FIG. 2, for example, in the present embodiment, the ventilation holes 132 of the supporting element 130 are kept a distance L1 away from the carrying layer 122, the apex of the supporting element 130 is kept a distance L2 away from the carrying layer 122, and the distance L1 is greater than a quarter of the distance L2. Thus, liquid spilled on the carrying layer 122 cannot enter the supporting element 130 since the ventilation holes 132 are disposed at a higher location. However, the disposed position of the ventilation holes 132 is not limited in the present invention, and the ventilation holes 132 may also be disposed at other suitable positions on the supporting element 130 in other embodiments.

As described above, in the present invention, a waterproof layer covers an assembly hole on a carrying layer so that liquid is prevented from entering an electronic device through the assembly hole. Accordingly, a waterproof effect is achieved. In addition, the ventilation hole of a supporting element, the ventilation hole of the carrying layer, the ventilation hole of the waterproof layer, and the inner space of a main body of the electronic device are connected with each other so that hot air produced in the electronic device can be expelled to the outside. Accordingly, a heat dissipation effect is achieved. Moreover, the ventilation hole of the supporting element may be disposed at a higher position and kept a distance away from the carrying layer, so that liquid on the carrying layer can be prevented from entering the supporting element through the ventilation hole of the supporting element.

It will be apparent to those skilled in the art that various modifications and variations can be made to the structure of the present invention without departing from the scope or spirit of the invention. In view of the foregoing, it is intended that the present invention cover modifications and variations of this invention provided they fall within the scope of the following claims and their equivalents.

What is claimed is:

1. An electronic device having a key, comprising:

a main body, having an inner space and an opening, wherein the opening exposes the inner space;

a carrying layer, disposed at the main body and covering the opening, wherein the carrying layer has a first ventilation hole and an assembly hole;

a waterproof layer, stacked on the carrying layer and located between the carrying layer and the main body, wherein the waterproof layer has a second ventilation hole, the first ventilation hole is exposed by the second ventilation hole and connected with the inner space, and the assembly hole is covered by the waterproof layer;

a supporting element, disposed on the carrying layer and covering the first ventilation hole, wherein the supporting element has at least one third ventilation hole, and the third ventilation hole is connected with the first ventilation hole;

a key, disposed on the supporting element; and a guiding element, locked at the assembly hole and connected to the key.

2. The electronic device according to claim 1, wherein the carrying layer and the waterproof layer are formed integrally.

3. The electronic device according to claim 1, wherein the supporting element is elastic, the key is suitable for moving along a direction substantially perpendicular to the carrying layer through an elastic deformation of the supporting element.

4. The electronic device according to claim 1, wherein the third ventilation hole is a first distance away from the carrying layer, an apex of the supporting element is a second distance away from the carrying layer, and the first distance is greater than a quarter of the second distance.

5. An electronic device having a key, comprising:

a main body, having an inner space and an opening, wherein the opening exposes the inner space;

a carrying layer, disposed at the main body and covering the opening, wherein the carrying layer has a first ventilation hole;

a waterproof layer, stacked on the carrying layer and located between the carrying layer and the main body, wherein the waterproof layer has a second ventilation hole, and the first ventilation hole is exposed by the second ventilation hole and connected with the inner space;

a supporting element, disposed on the carrying layer and covering the first ventilation hole, wherein the supporting element has at least one third ventilation hole, and the third ventilation hole is connected with the first ventilation hole; and a key, disposed on the supporting element.

6. The electronic device according to claim 5, wherein the carrying layer and the waterproof layer are formed integrally.

7. The electronic device according to claim 5, wherein the third ventilation hole is a first distance away from the carrying layer, an apex of the supporting element is a second distance away from the carrying layer, and the first distance is greater than a quarter of the second distance.

8. An electronic device having a key, comprising:

a main body, having an inner space and an opening, wherein the opening exposes the inner space;

a partition board, disposed at the main body and covering the opening, wherein a ventilation channel is formed on the partition board for exposing the inner space;

a supporting element, disposed on the partition board and covering the ventilation channel, wherein the supporting element has at least one ventilation hole, and the ventilation hole is connected with the ventilation channel; and a key, disposed on the supporting element.

9. The electronic device according to claim 8, wherein the partition board comprises a carrying layer and a waterproof layer, the supporting element is directly disposed on the carrying layer, and the waterproof layer is stacked on the carrying layer and located between the carrying layer and the main body.

10. The electronic device according to claim 9, wherein the carrying layer and the waterproof layer respectively have a first ventilation hole and a second ventilation hole, and the first ventilation hole and the second ventilation hole are connected with each other to form the ventilation channel.

* * * * *